US005505561A

United States Patent [19]

Willcox, III

[11] Patent Number: 5,505,561

[45] Date of Patent: Apr. 9, 1996

[54] SELF-PILOTING COMPRESSIBLE PILING

[75] Inventor: Frederick E. Willcox, III, Houston, Tex.

[73] Assignee: Perma Pile Foundation Restoration Systems, Inc., Houston, Tex.

[21] Appl. No.: 184,950

[22] Filed: Jan. 18, 1994

[51] Int. Cl.[6] ..... E02D 5/22

[52] U.S. Cl. ..... 405/251; 405/250; 405/253; 405/255

[58] Field of Search ..... 405/231, 232, 405/250, 251, 252, 253, 255, 256

[56] References Cited

U.S. PATENT DOCUMENTS

| | | | |
|---|---|---|---|
| 81,682 | 9/1868 | Porter | 405/231 |
| 2,187,677 | 1/1940 | Brumley | 405/250 |
| 2,983,104 | 5/1961 | Bruns | 405/252 |
| 3,104,532 | 9/1963 | Severinsson | 405/252 |
| 3,199,300 | 8/1965 | Fiore | 405/251 |
| 3,382,680 | 5/1968 | Takano | 405/252 |
| 3,504,500 | 4/1970 | Fristedt | 405/252 |
| 3,545,214 | 12/1970 | Grazel | 405/252 |
| 3,899,891 | 8/1975 | Kelly et al. | 405/251 |
| 3,953,981 | 5/1976 | Axelsson et al. | 405/251 |
| 4,074,500 | 2/1978 | Bisutti | 52/726 |
| 4,537,534 | 8/1985 | Marsh, Jr. | 405/252 |
| 4,604,003 | 8/1986 | Francoeur et al. | 405/252 X |

FOREIGN PATENT DOCUMENTS

| | | | |
|---|---|---|---|
| 215912 | 6/1961 | Austria | 405/253 |
| 1335469 | 7/1963 | France | 405/253 |
| 44171 | 5/1938 | Netherlands | 405/253 |
| 38460 | 11/1923 | Norway | 405/250 |
| 897963 | 1/1982 | U.S.S.R. | 405/231 |
| 962454 | 9/1982 | U.S.S.R. | 405/253 |
| 1090803 | 5/1984 | U.S.S.R. | 405/251 |
| 3444 | of 1915 | United Kingdom | 405/250 |
| 783624 | 9/1957 | United Kingdom | 405/251 |
| 849413 | 9/1960 | United Kingdom | 405/253 |
| 2067633 | 7/1981 | United Kingdom | 405/252 |

OTHER PUBLICATIONS

Perma Pile, Inc., "Perma–Pile vs. Drilled and Under–Reamed Piers For Underpinning Shallow Foundation," 1989.

Perma Pile Foundation Restoration System, Inc. "Perma Pile, Inc. System of Foundation Repair," 1986.

*Primary Examiner*—John A. Ricci

*Attorney, Agent, or Firm*—Vaden, Eickenroht, Thompson & Feather

[57] ABSTRACT

A self-piloting compressible piling is provided comprising a plurality of pre-formed pile sections having bores therethrough and adapted to be arranged in end-to-end relation such that the bores are concentrically collinear. An auger plate is positioned beneath the lowest of the sections and has an upper face and lower face. The lower face of the plate has a plurality of curved blades extending therefrom. The plate further has a flared bore concentrically collinear with the bores of the piling sections through its center such that the diameter of the hole is greater on the upper face than on the lower face. A tension-bearing cable having a collapsible lock-jaw mechanism secured to one end thereof is provided which is extendable from above the highest of the piling sections through the bores of the sections and the bore of the plate and engageable with the lower face of the plate for loading the sections and the plate in compression.

5 Claims, 1 Drawing Sheet

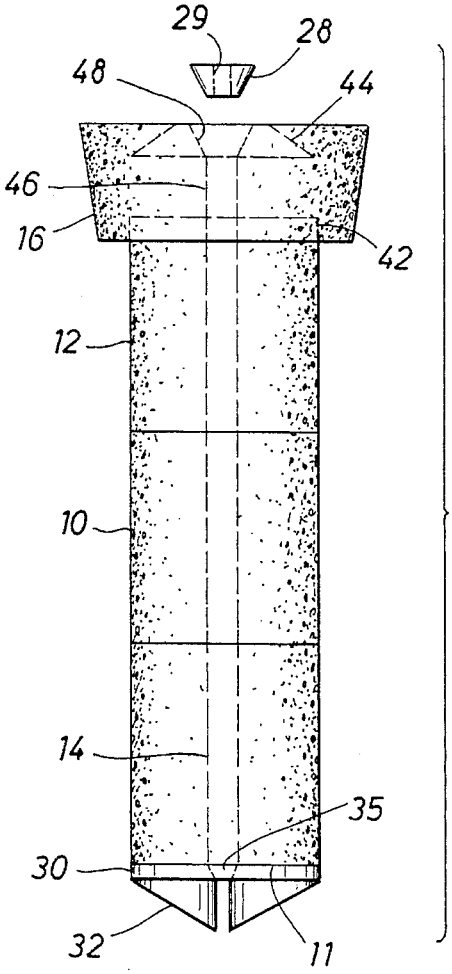
FIG. 1
FIG. 2
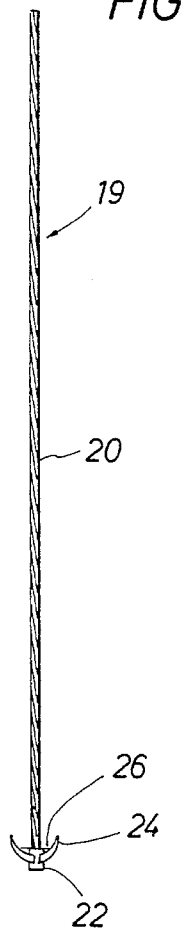
FIG. 3
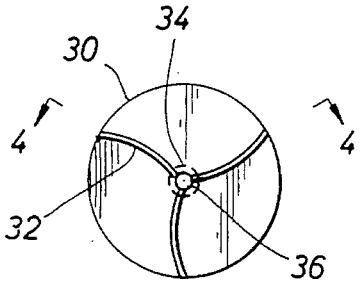
FIG. 4
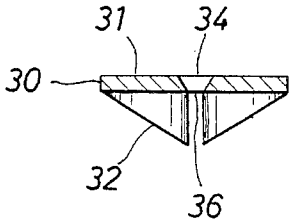

SELF-PILOTING COMPRESSIBLE PILING

BACKGROUND OF THE INVENTION

1. Field of the Invention

This invention relates to the field of foundation supports for buildings and other structures. More particularly, this invention relates to improvements in sectional piles.

2. Description of the Prior Art

Many structures have been built on foundations or slabs made of concrete poured on top of soil. Constant changes in the weather and moisture levels in the soil frequently cause damage to such a foundation. In many instances, the foundation may buckle or even crack.

This phenomenon occurs because prior to placing the foundation on the ground, the moisture beneath it is constant. Placing a foundation on the soil distorts the evaporation of the moisture underneath the foundation, thereby causing water buildup and relative soil swelling in the middle of the structure. Eventually, an uplifting can occur in the center because the moisture from around the edges of the structure relative to the center is drawn away by evaporation and/or by wicking action of the adjacent shrubbery or plant life. Over a period of time the foundation can "dome," causing damage or failure.

There are several methods used in repairing foundations. One of the most effective and widely used methods includes the use of one or more piles submerged into the soil beneath the foundation to form one or more supports. Most of the supports are made primarily of concrete and have an overall cylindrical shape with a length varying according to the soil type and the weight of the structure. For clarity, the words "piling section" and "section" signify a single cylindrical piece, and the words "pile" and "piling" signify a plurality of sequentially stacked pieces (sections) to form a single support column. A plurality of piles or pilings then provide overall load support for a structure in the form of a piling system.

One of the most successful foundation rehabilitation procedures involves excavating, or partially excavating, underneath the grade beams that need to be supported or raised, placing a concrete piling section in the excavated cavity underneath the grade beam, placing a construction jack between the grade beam and the piling section, and then operating the jack by hydraulic or pneumatic action to force the piling section downward into the ground while supporting the grade beam. Once the piling section is driven sufficiently into the ground so that its top is flush with the bottom of the excavated area, another piling section is put in place on top of the previous piling section and the jack is reactivated. Eventually, either the piling made up of the piling sections will hit bedrock or the ground underneath and surrounding the piling will become so compacted as to make further piling section additions unnecessary.

When a concrete piling of extended length formed by axially coupling a number of piling sections is driven in place, even slight differences in axial alignment between the sections will result in a large axial deflection in the pile at its lower, leading end. Known pile joint and coupling devices permit varying degrees of tolerance in the alignment of the piling sections. The piling sections are thus subjected to a broad range of bending stresses when the piling is loaded with the grade beams. As such, there remains a need in foundation construction for easily assembled, precision aligned piling sections.

Accordingly, it is an object of the present invention to provide a piling with precision axial alignment of its piling sections. This and other objects and advantages of the present invention will be evident from the following drawings, specifications and claims.

SUMMARY OF THE INVENTION

The present invention is a self-piloting compressible piling comprising a plurality of pre-formed pile sections having bores therethrough and adapted to be arranged in end-to-end relation such that the bores are concentrically collinear.

An auger plate is positioned beneath the lowest of the piling sections and has an upper and lower face. A flared bore, concentrically collinear with the bores of the sections, passes through the center of the plate. The diameter of the bore is greater on the upper face than on the lower face of the auger plate. The lower face of the auger plate has a plurality of curved blades extending therefrom.

The piling further includes means extendable from above the highest of the sections down through the bores of the sections and the bore of the auger plate. These means are engageable with the lower face of the plate for loading the sections and the plate in compression.

In a preferred embodiment of the piling, the means for loading the sections and the plate in compression comprises a tension-bearing cable having a collapsible lock-jaw mechanism secured to one end thereof. The jaws will collapse upon placement of the mechanism into the bores of said sections and will open upon passage of the mechanism through the bore in the auger plate.

An anchoring mechanism is also provided and placed atop the highest of the piling sections for applying tension to the cable whereby the sections and the auger plate will be loaded in compression.

BRIEF DESCRIPTION OF THE DRAWINGS

In the drawings, wherein like reference characters are used throughout to describe like parts:

FIG. 1 is a schematic view of a piling according to the present invention.

FIG. 2 is a schematic view of a cable and lock mechanism according to the present invention.

FIG. 3 is a schematic view of the lower face of the auger plate depicted in FIG. 1.

FIG. 4 is a sectional view of the auger plate taken on the line 4—4 of FIG. 3.

DETAILED DESCRIPTION OF THE PREFERRED EMBODIMENT

FIG. 1 illustrates the presently preferred embodiment of the present invention. A self-piloting compressible piling, referred to generally as 10, comprises a plurality of pre-formed pile sections 12 having bores 14 therethrough. Each of the sections 12 are adapted to be arranged in end-to-end relation such that the respective bores 14 are concentrically aligned in linear fashion. The sections 12 are identical and generally in the shape of right-circular-cylinders and have outer diameters ranging from 4" to 14" depending on the structure being supported. The height of each section also varies for different applications, but typically falls in the range of 8" to 12".

An auger plate 30 is placed in the soil prior to and positioned beneath the lowest of the piling sections and has an upper and lower face. A flared bore 35 concentrically collinear with the bores 14 of the piling sections 12 passes through the center of the plate 30. The diameter of the bore 35 is greater on the upper face than on the lower face of the auger plate, with a typical ratio of 5 to 3. The smaller lower face diameter typically varies from 0.5" to 0.75". The bore openings on the upper and lower faces of plate 30 are respectively referred to as 34 and 36 as shown in FIGS. 3 and 4.

The lower face of the auger plate 30 has a plurality of curved blades 32 extending therefrom. A presently preferred embodiment contains three blades 32, each spaced 120 degrees apart. The shape of the blades permit the auger plate to rotate relative to the piling sections when the sections are being driven into the soil. The curved blade shape translates the upward reactive force of the soil to lateral forces on the sides of the blades 32, tending to rotate plate 30. Relative rotation is enabled by complimentary bearing surfaces 31 and 11 provided respectively at the upper face of plate 30 and the lower face of lower piling section 12. The rotary action of the plate may further aid in cutting through the soil and guide the piling as it is driven.

The piling 10 further includes means 19 extendable from above the highest, or last, of the sections 12 through the bores 14 of the sections and the bore 35 of the auger plate 30. These means are engageable with the lower face of the plate 30 for loading the sections 12 and the plate 30 in compression.

In a presently preferred embodiment of the piling 10, the means for loading the sections 12 and the plate 30 in compression comprises a tension-bearing cable 20 having a collapsible lock-jaw mechanism 22 secured to one end thereof, as illustrated in FIG. 2. The jaws 24 will collapse upon placement of the mechanism into the bores 14 of the sections 12 and will open upon passage of the mechanism 22 through the bore 35 in the auger plate 30. The jaws 24 are normally expanded away from the cable 20 by the force of a coil spring 26, or other expandable means.

Thus, placement of mechanism 22 within bores 14 and particularly within bore 35, by way of cable 20, will cause jaws 26 to fold, compressing spring 26. Once cable 20 is fed into bores 14 a sufficient depth, mechanism 22 will exit reduced diameter bore opening 36 and the force of spring 26 as well as gravity will open jaws 24.

The upper end of cable 20 will be secured by chuck 28 positioned within piling cap 16. Cap 16 is provided with bore 46 which is concentrically collinear with bores 14, recess 42, and tension plate 44. Upper piling section 12 is preformed within recess 42 such that the upper section is set atop the piling with cap 16 as a single component.

Metal tension plate 44 is preset within cap 16 and is provided with tapered bore 48 concentrically collinear with bore 48. The diameter of bore 48 is greater on the upper face of plate 44 than on the lower face thereof, with a typical ratio of 3 to 2. A frusto-conical chuck 28 is adapted to be positioned within bore 48. Chuck 28 is provided with adjustable diameter bore 29 therethrough for securing cable 20 within cap 16.

To summarize the process, once the completed piling 10 has been driven into the soil, the cable 20 is lowered through the bores 48, 46, and 14. When the jaws 24 have passed through the opening 35, the cable 20 is pulled upward so that jaws 24 will engage the lower face of auger plate 30. The jaws 24 of mechanism 22 must be oriented such that they will be positioned intermediate the blades 32 of plate 30. In the preferred embodiment, three jaws 24 are therefore used. Once the jaws are locked against the lower surface of plate 30, the upper end of cable 20 is fed through bore 29 of chuck 28 and the chuck is positioned within bore 48.

Those skilled in the art and given the benefit of this disclosure will appreciate that variations on the locking-jaw mechanism 22 may be successfully substituted for that disclosed herein. All that is required is a mechanism for loading the sections 12 in compression through the application of a tensile force within bores 14.

An anchoring mechanism (not shown) is provided and placed atop the highest, or last, of the piling sections 12 for applying tension to the cable 20 above chuck 28 such that the piling cap 16, sections 12, and auger plate 30 will be loaded in compression. A compressive loading between sections 12 will ensure precise seating of the common ends therebetween, reducing the likelihood of misalignment along the axis of the piling 10.

Once the piling is sufficiently compressed, chuck 28 is activated to reduce the diameter of bore 29 until cable 20 is secured with a force sufficient to maintain the tension in the cable. At this time, anchoring mechanism 40 may be removed as the compressive loading on the piling 10 is maintained by jaws 24, chuck 28, and cable 20.

From the foregoing, it will be seen that this invention is well adapted to attain all the ends and objects herein set forth, together with other advantages which are obvious and inherent to the piling.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as being illustrative and not in a limiting sense.

What is claimed is:

1. A self-piloting compressible piling comprising:

a plurality of pre-formed pile sections having bores therethrough and adapted to be arranged in end-to-end relation such that the bores are concentrically collinear;

an auger plate positioned beneath the lowest of said sections for rotation with respect thereto and having an upper and lower face, the lower face having a plurality of curved blades extending therefrom and the upper face being adapted for rotation of said auger plate relative to the lowest of said sections, and a bore concentrically collinear with the bores of said sections through the center of said plate; and means extendable from above the highest of said sections through the bores of said sections and the bore of said plate and engageable with the lower face of said plate for loading said sections and said plate in compression.

2. The piling of claim 1 in which said loading means comprises a tension-bearing cable having a collapsible lock-jaw mechanism secured to one end thereof such that the jaws will collapse upon placement of the mechanism into the bores of said sections and open upon passage of the mechanism through the bore in said plate, said cable loading said sections and said plate in compression when subjected to a tensile load from atop the highest of said sections.

3. The piling of claim 1 in which the auger plate is flared such that the diameter of the bore is greater on the upper face than on the lower face.

4. The piling of claim 1 additionally comprising a bored piling cap positioned atop the highest of said sections and adapted for securing said loading means to maintain the compression on said sections and said plate, the bore of said cap being concentrically collinear with the bores of said sections.

5. The piling of claim 4 additionally comprising a chuck adapted for placement within the bore of said cap and having a bore therethrough of variable diameter.

* * * * *